US005267556A

United States Patent [19]

Feng

[11] Patent Number: 5,267,556

[45] Date of Patent: Dec. 7, 1993

[54] SNORKEL WITH A LATERALLY EXTENDED DOWNWARD OPENING FOR AIRFLOW ENTRY AND A UNIVERSALLY ADJUSTABLE MOUTHPIECE

[76] Inventor: Le-Jang Feng, 1 Fl., No. 22-10, Lane 50, Tien Mu E. Rd., Taipei, Taiwan

[21] Appl. No.: 13,583

[22] Filed: Feb. 4, 1993

[51] Int. Cl.[5] ..... B63C 11/16

[52] U.S. Cl. ..... 128/201.11; 128/207.14

[58] Field of Search ..... 128/201.11, 207.17, 128/201.26, 201.27, 201.28

[56] References Cited

U.S. PATENT DOCUMENTS

| | | | |
|---|---|---|---|
| 4,782,830 | 11/1988 | Forman | 128/201.11 |
| 4,884,564 | 12/1989 | Lamont | 128/201.11 |
| 5,092,324 | 3/1992 | Christianson | 128/201.11 |
| 5,117,817 | 6/1992 | Lin | 128/201.11 |
| 5,199,422 | 4/1993 | Rasocha | 128/201.11 |

FOREIGN PATENT DOCUMENTS

| | | | |
|---|---|---|---|
| 2848645 | 5/1979 | Fed. Rep. of Germany | 128/207.14 |
| 1191212 | 4/1959 | France | 128/201.11 |

OTHER PUBLICATIONS

"Dacor Integra Snorkels", Susan Waters, Skin Diver Magazine, May 1992, p. 48.

Dacor Integra Advertisement, May 1992.

*Primary Examiner*—Edgar S. Burr

*Assistant Examiner*—Eric P. Raciti

*Attorney, Agent, or Firm*—Pro-Techtor International

[57] ABSTRACT

The present invention offers a snorkel with a laterally extended downward opening for air entry and a universally adjustable mouthpiece, specifically, a tube-like lateral extension from the top-end opening of the snorkel tube shares the same air space of the snorkel tube, by sharing the same top-end opening, and then is covered at that shared top-end opening to direct airflow in and out of the snorkel tube to the downward opening of the lateral extension, beneath which an upward-facing, protruding shield is placed, with the shield opening and the downward opening joining on the same plane to block out water while allowing airflow in and out along the protruding opening of the shield; the bottom of the shield is provided with a unidirectional diaphragm with an off-centered shaft for easy drainage; and the height difference between the downward opening and the top-end opening blocks water from entering the snorkel tube when the water level is at the downward opening, even though a little bit of water falls into the shield, it can be easily and naturally drained into the unidirectional diaphragm maintaining the dryness and smoothness inside the snorkel; the lower-end opening of the snorkel tube and the mouthpiece holder are assembled together by the spherical concave wall and the hollow sphere, respectively provided thereto, so that the mouthpiece holder and the mouthpiece thereon can be adjusted to any comfortable and natural angle of use, through the spherical rotation of the hollow sphere along the spherical concave wall.

4 Claims, 6 Drawing Sheets

SNORKEL WITH A LATERALLY EXTENDED DOWNWARD OPENING FOR AIRFLOW ENTRY AND A UNIVERSALLY ADJUSTABLE MOUTHPIECE

BACKGROUND OF THE INVENTION

1. Field of the Invention

The present invention involves a snorkel and its structure, specifically, a snorkel tube has a lateral extension at the top to direct airflow downward, eliminating suffering and danger from these common problems: swallowing water in the snorkel, throat irritation, nasal discomfort, and in the worst possible case, choking. This invention also includes a universally adjustable mouthpiece, which corrects angular deflection associated with normal mouthpiece use.

2. Description of the Prior Art

In scuba diving, the snorkel, the mask and fins are important pieces of equipment, however in snorkelling (also known as skin diving or bare-handed diving), the snorkel is the most important piece because it lets you swim just below the water surface continously, with a breathing tool.

The structure of the present conventional snorkel is usually the following: a round hollow tube (1.5–2.0 cm in diameter and 30–40 cm in length) with an opening at the top for air intake and outtake. The bottom of the tube is usually connected to a mouthpiece soft and suitable for its user. A clip may be attached to the tube in order to join the snorkel to the mask.

Using a conventional snorkel can be relatively simple. A clip usually fixed to the mask strap must also be fixed to the snorkel so that the snorkel is ready for positioning (usually near the ear). The mask is placed over the head to enclose the eyes and nose. Next, the mouthpiece is inserted into the mouth. Biting down on it usually aids in maintaining a smooth airflow. Now you're ready to submerge face down in water. The snorkel tube top-end opening should protrude approximately 15 cm above the water surface. You can now breathe through the snorkel while enjoying the underwater world.

The conventional snorkel therefore allows continuous breathing while swimming face down in the water. However, the opening at the top end of the snorkel easily allows sea water to enter. Waves passing over the snorkel will immediately fill the snorkel with water and if you fail to keep your head in a certain angle causing the snorkel's top opening to touch the water surface, the snorkel will become flooded.

Once you notice water flowing into the snorkel, you must stop breathing or else swallow water. Then, by using your abdominal strength to blow out the water from the snorkel, you can clear the snorkel's air passageway and resume breathing. You must continue to clear the snorkel as long as the water keeps entering the snorkel and until you stop snorkeling.

Indeed, these water clearing techniques require time to learn and master. And for a beginning diver, snorkel clearing can be dangerous. Slight carelessness can even cause one to choke on water. Even the skilled diver fully experienced in snorkel clearing techniques sometimes accidentally swallows water and gets that irritating feeling in his throat and nose. And constantly having to clear water for a long period of time uses quite a bit of energy, causing one to tire easily. A mouth full of sea water can also be quite uncomfortable. These are all serious drawbacks of the conventional snorkel.

Ergonomically, the conventional snorkel lacks suitability at the mouthpiece. For instance, the conventional mouthpiece is normally fixed on a rigid shaft or a corrugated flexible lower tube, both of which offers very little adjustment or none at all. Since the snorkel is attached to the maskstrap close to the ear, when the mouthpiece is put in the mouth, the angular difference between the ear and mouth leads to a deflection between the mouthpiece and the snorkel, and since the snorkel is fixed onto the maskstrap, this deflection tends to exist on the mouthpiece, generating a constant, forceful deflection and disengagement from the mouth. The deflection is then compensated by biting on the mouthpiece in order to prevent the mouthpiece from further coming out of the mouth.

An alternate mouthpiece involves one that rotates to-and-fro, also termed "swivelling". This type of mouthpiece eliminates some angular difference but it cannot be adjusted to suit all types of face shapes and sizes, and so it remains generally uncomfortable.

Snorkeling time usually takes between 1–2 hours. During this time, if the snorkeler must constantly be biting on his mouthpiece, he will experience "jaw fatigue". Clearly, the mouthpiece on the present conventional snorkel is an obvious drawback and one that warrants immediate correction.

SUMMARY OF THE INVENTION

This invention effectively improves the conventional snorkel, eliminating the drawbacks mentioned above. These drawbacks concerned the undesirable water inflow and uncomfortable wear at the mouthpiece. The objective of this invention is to provide a snorkel with a lateral extension that directs airflow downward and a universally adjustable mouthpiece.

The present invention is characterized by the following design: a tube-like lateral extension from the top of the snorkel tube shares the same top-end opening as that of the snorkel tube and also has a downward opening at its lower-end opening. A cover is then placed over the top-end opening, thereby directing the airflow through the downward opening.

A shield blocks water from entering the downward opening's air passageway, and at the same time, allows airflow through its protruding opening. In order for air to flow smoothly while blocking out water, the shield's opening must join with the downward opening on the same plane.

The shield has a grid-like base to act as a drain and a unidirectional diaphragm is attached under the base to prevent water from entering through the base of the shield.

Water is further blocked from entering the snorkel tube by a wall between the snorkel tube and the lateral extension. The wall also provides a "height differential" between the top-end opening of the snorkel tube and the lower-end opening of the second tube, so that while air can flow over and above the two tubes, water cannot travel beyond the wall. The small amount of water that does fall into the shield opening automatically drains down into the unidirectional diaphragm at the base of the shield.

By thus preventing water inflow, the snorkel-insides maintains dryness and smoothness throughout. A diver or snorkeler can now be free of danger and needless suffering of water in his throat and lungs.

This invention also incorporates another design at the lower-end opening of the snorkel tube. A hollow sphere on the front end of the mouthpiece holder fits snugly into the spherical concave inner wall of the snorkel tube's lower end-opening. This "ball joint" effect is indeed a universally adjustable joint that can be adjusted optionally, three dimensionally and in infinite directions to suit one's individual comfort level at the mouthpiece.

DETAILED DESCRIPTION OF THE PREFERRED EMBODIMENT

Figure 1:
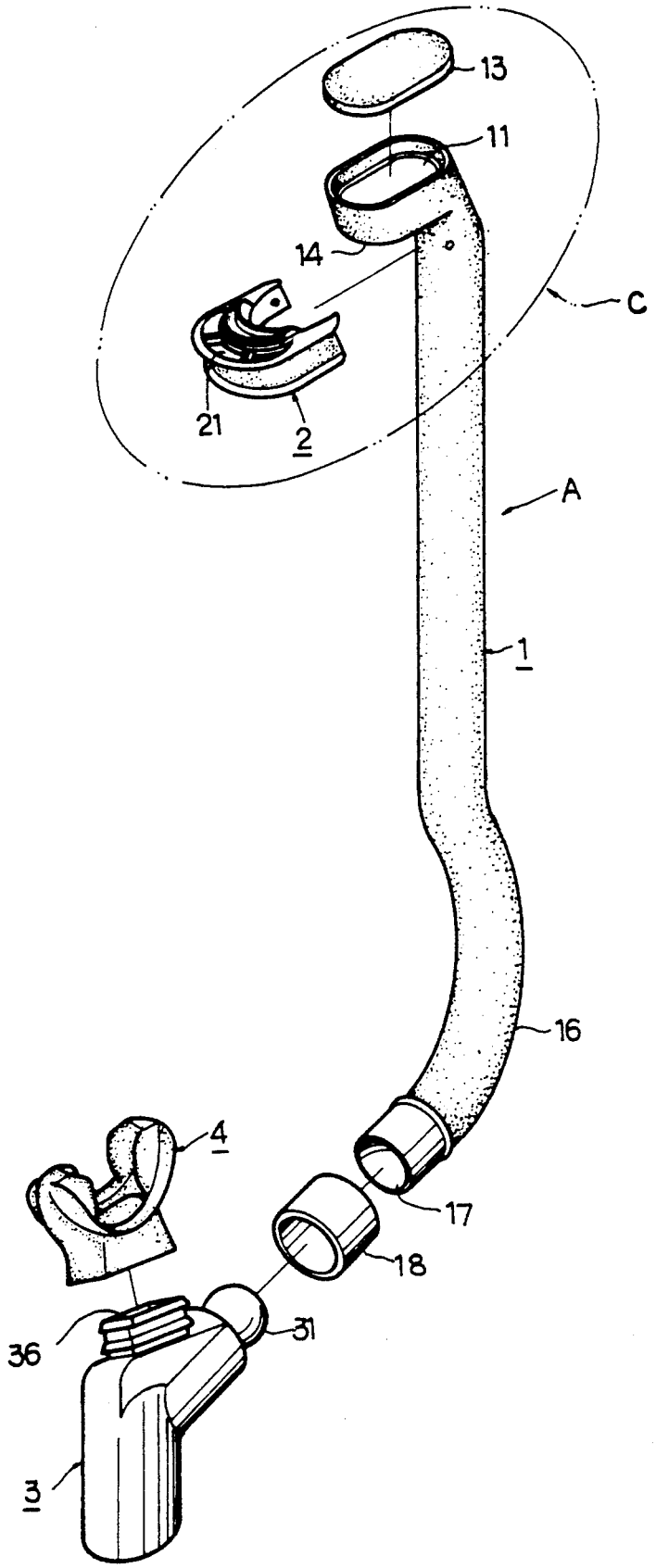
FIG. 1 shows the breakdown of the present invention.

The structure of the present snorkel invention(A) consists essentially of a tube(1), a shield(2), a mouthpiece holder(3) and a mouthpiece(4). See FIG. 1 and 2.

In detail, as shown in FIG. 1 through 4, a lateral entension from the top-end opening(11) of the main tubed) is parallel to but shorter in length than the main tube(1). The lateral extension shares the same air space as the main tube(1) at the top-end opening(11). The lateral extension(12) opens downward(14), while a cover(13) is placed over the tops of the lateral extension(12) and the main tube(1) to direct airflow through the downward opening(14).

The lateral extension(12) and the main tubed) are divided by a wall(15). This wall(15) creates a difference in height between the downward opening(14) of the lateral extension(12) and the top-end opening(11) of the main tube(1).

A shield(2) attaches onto the tube(1) directly beneath the downward opening(14) of the lateral extension(12), so that the shield opening(21) joins with the downward opening(14) on the same plane.

The shield(2) opens upward(21), extending laterally beyond the downward opening(14) so air can enter from the shield opening(21). Air then travels through the joined air spaces of the downward opening(14) and then through the top-end opening(11).

The base of the shield(2) has a gridded opening(22) for draining water. A unidirectional diaphram(23) underneath the shield base(2) prevents water entry by opening only downward. The diaphragm's base is located below the grid. But the diaphragm(23) has a protruding shaft(24) which goes through the shield in order to stick to the bottom of the shield(2).

This shaft(24), normally placed in the center of the diaphragm, has been purposefully off-centered and strategically placed at the end of the diaphram(23) towards the wall(15). This shifting of the shaft(24) allows the diaphram to drain water more easily by enlarging the diaphram's exit area, giving the water more leverage.

An outward arc(16) at the lower end of the main tube(1) conforms to the wide jaw section of the human face.

On the inside of the lower-end opening of the main tube(1), there is a spherical concave wall(17). Fitted into this concave wall(17) is a hollow sphere(31) located at the front end of the mouthpiece holder(3), thereby forming a "ball joint" effect. This phenomena allows the mouthpiece holder(3) to be universally adjusted through the spherical rotation of the hollow sphere(31) along the spherical concave wall(17).

A thimble(18), attached to the outer perimeter of the spherical concave wall(17), maintains a snug fit at the universal joint, to immobilize the mouthpiece holder(3) once adjusted into position.

The mouthpiece holder(3) has three openings all connected to each other. One opening, the front opening(32) has a hollow sphere(31), the second opening, the downward opening, has a drain opening(33) with numerous spaced holes(34) and a unidirectional diaphram(35) openable only downward for water drain. The third opening, the mouthpiece opening(36) rises upward for a mouthpiece(4) installation. The opening(36) has on its outer perimeter numerous non-skid stripes(37) for nesting a soft mouthpiece(4) suitable to the individual.

Figure 2:
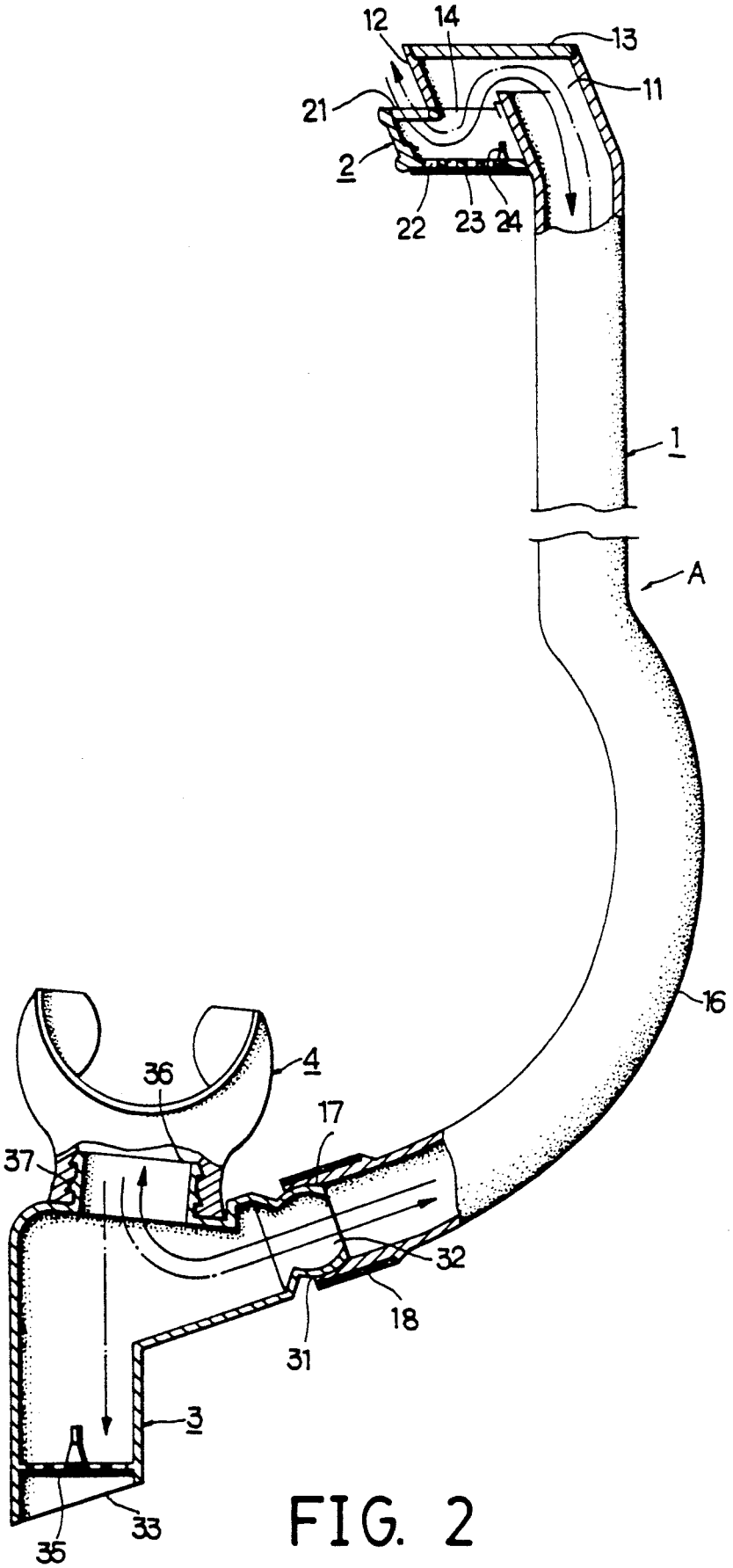
FIG. 2 shows the assembly of the present invention through a cross section.
Figure 3:
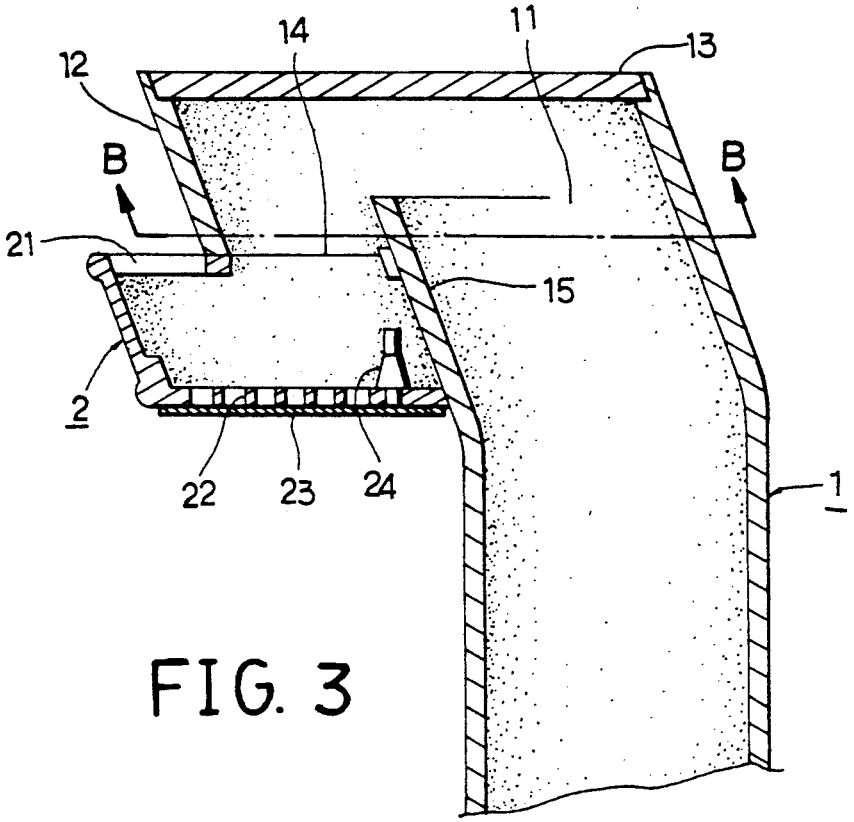
FIG. 3 shows an enlarged section of the top-end of the snorkel as shown in FIG. 2.
Figure 4:
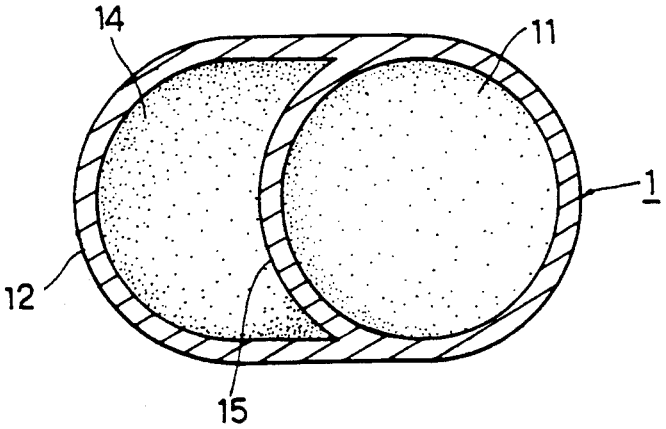
FIG. 4 views the cross section taken along the line B—B of FIG. 3.

The present invention is used in the following manner. You bite down on and enclose the mouthpiece(4) in order to get air from the outside. The outside air will flow in to the snorkel (A) through the following path: through the shield opening(21), the downward opening(14), the top-end opening(11), interior of the main tubed), the hollow sphere(31), the mothpiece opening(36) and then the mouthpiece(4). FIG. 2 shows this air flow in and out of the snorkel(A). Using this present invention, you will now be able to continue breathing through your mouth while swimming face down in water.

Figure 5:
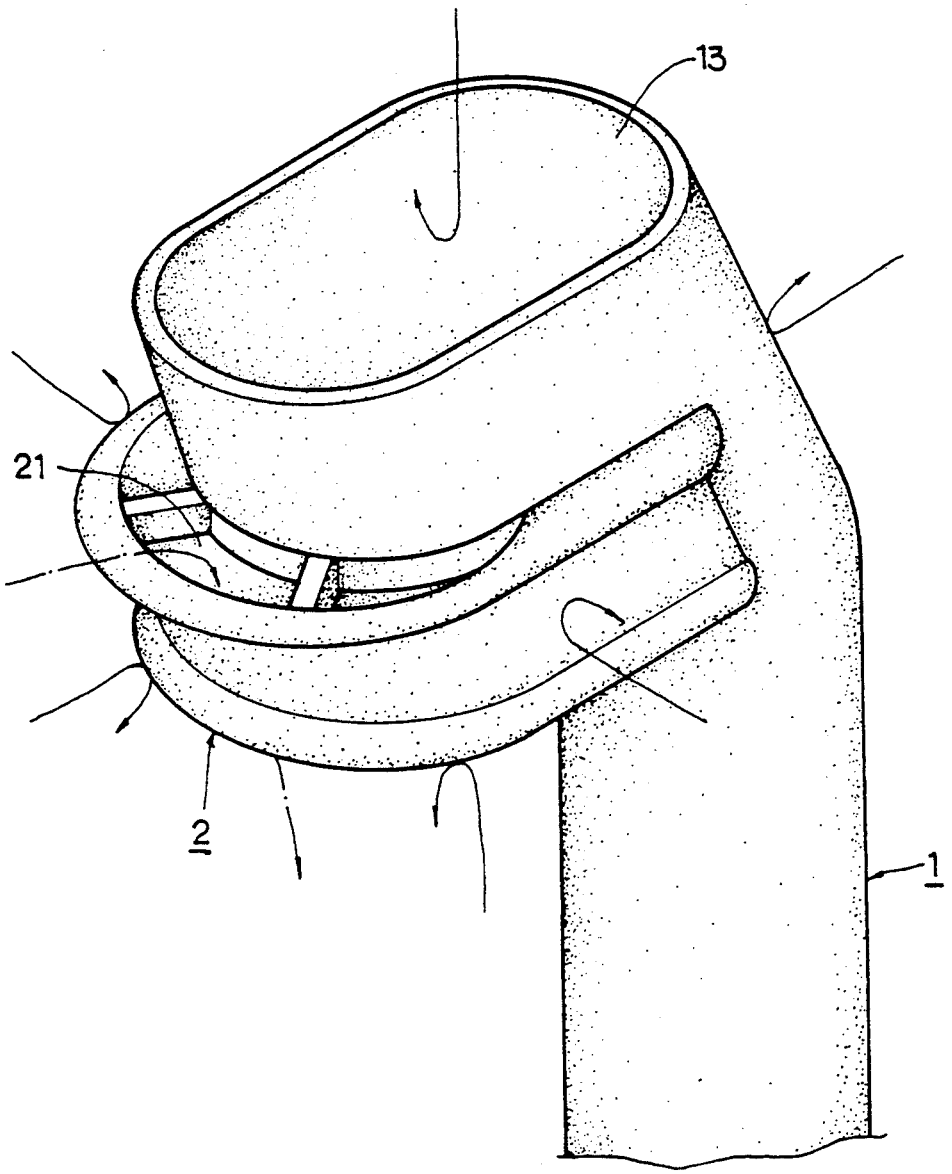
FIG. 5 is an enlarged assembly view of Part C of FIG. 1 showing how water is blockaded.

Meanwhile water or waves or splashes will be blocked from entering the snorkel from these directions: the front, rear, left, right and lower directions (see FIG. 5). Water inflow is further blocked by the upward facing shield(2) and the unidirectional diaphram(23) closing up the base of the shield(2). Even if a little bit of water falls down into the shield(2) from the shield opening(21), it will automatically drain into the unidirectional diaphram(23) at the base of the shield(2).

And even when the snorkel is not in an upright position, with its shield opening(21) touching the water, water cannot enter the main tubed) because a wall(15) blocks water from entering in from the lateral extension(12). The height differential between the two openings (11)(14) also ensures that water will not pass the main tube opening(11), because water does not travel upward according to the law of gravity.

Therefore when water is blocked from entering the snorkel tubed(1) from the shield opening(21), the snorkel tube will be dry and smooth, and very comfortable to breathe air. The danger of swallowing water or irritating your throat or nose by the water can be eliminated.

However, if the snorkel is completely submerged in water and then brought to the surface, the water in the snorkel can be easily blown into the unidirectional diaphragm(23) with its highly-leveraged off-centered shaft(24).

Figure 6:
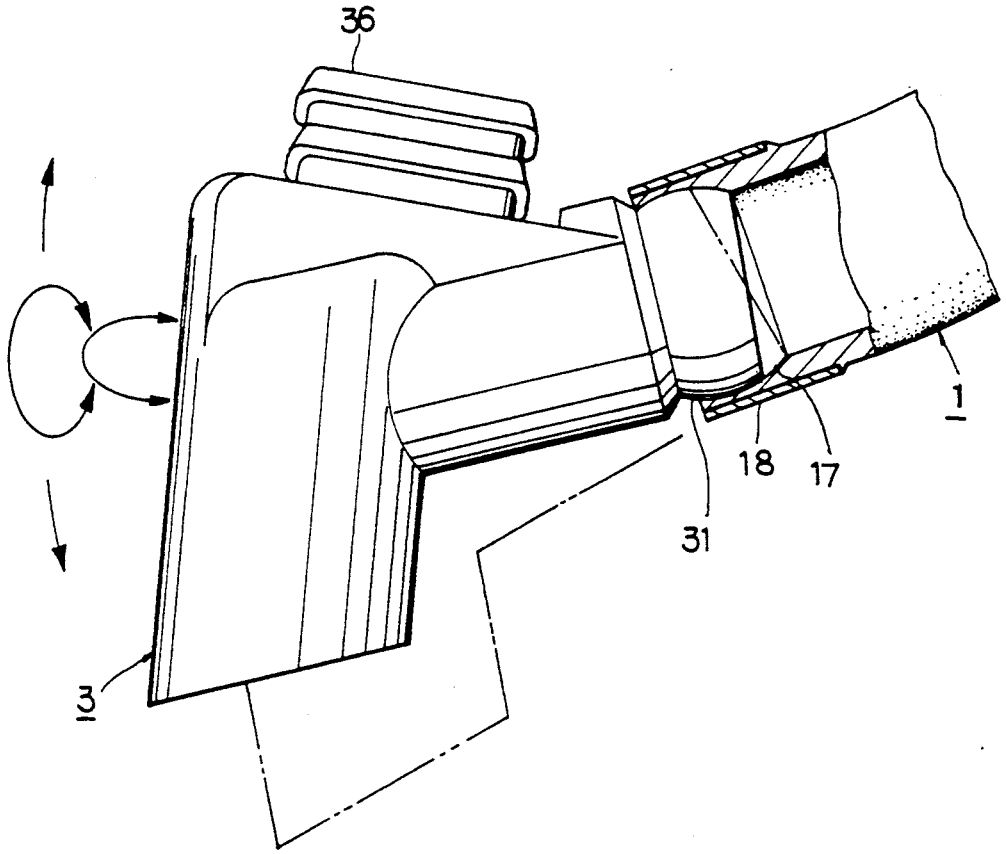
FIG. 6 is an enlarged cross section view of the lower-end opening of the snorkel as shown in FIG. 2 and shows the angular adjustment of the mouthpiece holder and mouthpiece.
Figure 7:
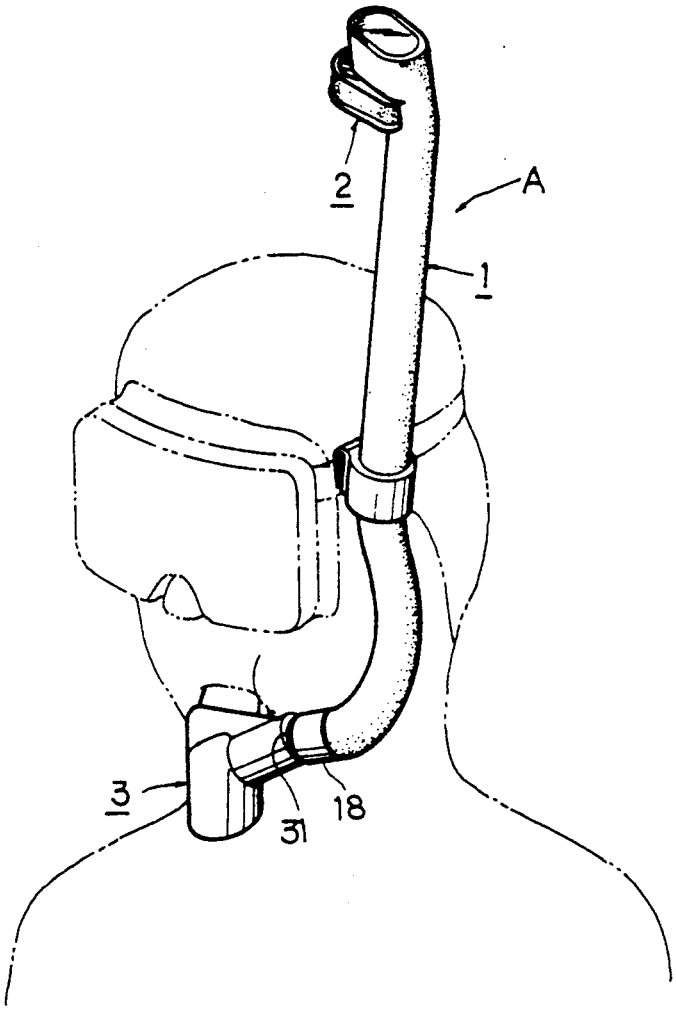
FIG. 7 is a schematic view of wearing and using the present invention.

With this present invention, the spherical rotation of hollow sphere(31) along the spherical concave wall(17) of the main tube(1) allows the mouthpiece holder(3) and mouthpiece(4) to be adjusted universally, optionally, three-dimensionally and in an infinite number of directions (see FIG. 6). Therefore, the normal distortion between the mouthpiece(4) and main tube(1) can be adjusted and the snorkel can be adjusted to a comfortable and natural position suitable to one's face, as shown in FIG. 7.

The mouthpiece(4) will maintain its position, not tending to come off the mouth, the mouthpiece no longer needing to be clenched down-upon, rather, held lightly in the mouth to lessen the burden of his mouth and to minimize jaw fatigue.

Another labor-saving feature is the alignment of the mouthpiece opening(36) and the drain opening(33). They are directly oppositely placed so that water can drain more efficiently.

I claim:

1. A snorkel apparatus for a skin diver comprising:

a snorkel tube having a body with a top end and a bottom end, said top end having an opening, said bottom end having an inner wall which is spherical and concave;

a tube-like lateral extension connected to the top end of said snorkel tube and having a passage which is substantially parallel to and shorter in length than said snorkel tube and wherein the passage has a top end which is coterminous with said snorkel tube at said top end of said snorkel tube;

said lateral extension having a downward opening facing away from said top end;

a cover placed over said top end of said snorkel tube and said passage to direct airflow through the downward opening of the lateral extension;

said downward opening and said top end being axially spaced from one another and separated one from the other by said snorkel tube body;

a mouthpiece holder having a front end opening, said front end opening further comprising a hollow sphere operatively cooperating with said spherical concave inner wall of said snorkel tube, such that the mouthpiece older is capable of swivelling adjustment to accommodate a skin diver; and a mouthpiece nested on the mouthpiece holder for swivelling adjustment therewith.

2. A snorkel apparatus for a skin diver, as claimed in claim 1, which has a shield having a base and an opening, said opening being attached to the snorkel tube directly beneath the downward opening of the lateral extension; the shield faces upward toward the downward opening but extends beyond it, with the shield opening and the downward opening joined on the same plane; and the shield has numerous spaced holes at said base for a drain and a unidirectional diaphram openable only downward.

3. A snorkel apparatus for a skin diver as in claims 1 or 2, wherein the mouthpiece holder is a tee joint further comprising said front opening having said sphere, a downward opening having a drain with spaced holes and a unidirectional diaphragm, and an upward opening connectable to said mouthpiece; wherein said upward opening and said downward opening are slightly oriented toward one another.

4. A snorkel apparatus for a skin diver, as claimed in claim 2, wherein the unidirectional diaphragm is mounted on said base of said shield exterior to said passage, said unidirectional diaphragm comprising a body and a shaft extending off-center therefrom.

* * * * *